US007670546B2

(12) United States Patent
Poloni et al.

(10) Patent No.: US 7,670,546 B2
(45) Date of Patent: Mar. 2, 2010

(54) CONTROL DEVICE OF A STOPPER-ROD

(75) Inventors: Alfredo Poloni, Fogliano Redipuglia (IT); Andrea De Luca, Remanzacco (IT); Claudio David, Udine (IT)

(73) Assignee: Danieli & C. Officine Meccaniche S.p.A., Buttrio (IT)

( * ) Notice: Subject to any disclaimer, the term of this patent is extended or adjusted under 35 U.S.C. 154(b) by 335 days.

(21) Appl. No.: 11/720,499

(22) PCT Filed: Nov. 29, 2005

(86) PCT No.: PCT/EP2005/056310

§ 371 (c)(1),
(2), (4) Date: May 30, 2007

(87) PCT Pub. No.: WO2006/058881

PCT Pub. Date: Jun. 8, 2006

(65) Prior Publication Data

US 2008/0190971 A1 Aug. 14, 2008

(30) Foreign Application Priority Data

Nov. 30, 2004 (IT) ..... MI2004A2301

(51) Int. Cl.
*B22D 41/20* (2006.01)

(52) U.S. Cl. ..... 266/78; 266/272; 222/602

(58) Field of Classification Search ..... 266/78, 266/272; 222/602
See application file for complete search history.

(56) References Cited

U.S. PATENT DOCUMENTS 4,905,755 A * 3/1990 Lothmann ..... 222/602
5,118,084 A * 6/1992 Paulus et al. ..... 266/236
5,421,559 A 6/1995 Basler
5,674,426 A 10/1997 Schmid et al.

FOREIGN PATENT DOCUMENTS

EP WO0247852 A1 6/2002

* cited by examiner

*Primary Examiner*—Scott Kastler
(74) *Attorney, Agent, or Firm*—Sampson & Associates, P.C.

(57) ABSTRACT

Control device for a stopper-rod to regulate the outflow of liquid metal through a calibrated hole of a pouring receptacle comprising motor means, suitable to operate lifting and lowering means (2) of the stopper (4) by means of first driving means (7) and second driving means (14, 14'), the latter being suitable to convert a rotating motion into a translational motion, wherein the second driving means are flexible longitudinal elements and are fixed at a first end thereof to lifting and lowering means and a second end thereof to an anchor element (9), integral with the first means.

12 Claims, 3 Drawing Sheets

CONTROL DEVICE OF A STOPPER-ROD

FIELD OF THE INVENTION

The present invention relates to a control device of a stopper, in particular of a stopper-rod used to regulate the outflow of liquid steel through a ladle or a tundish.

PRIOR ART

The stopper-rod, or simply stopper, is the device which interacts with a calibrated hole or nozzle to regulate the outflow of liquid steel through a ladle or a tundish. Continuous regulation of the stopper takes place as a function of the level of steel in the ingot mould which is continuously monitored by a radioactive sensor that sends a signal to a programmable logic controller which, in turn, controls the motor of the device to control or move the stopper. The control device must control the stopper so as to continuously guarantee a stable meniscus in the pouring receptacle, and therefore it must allow a high operating speed of said stopper, especially for high pouring speeds. Two types of control device are known: one electromechanical and one hydraulic. Having defined the performance of a stopper as the time it takes to reach 60% of the step representing a vertical movement of the stopper of 2 mm, the performance of an electromechanical stopper is around 75 milliseconds, while the performance of a hydraulic stopper is around 50 milliseconds. Notwithstanding the type of motor, the response time is limited by the mechanical play of the system, which prevents precise control of the operating position.

The electromechanical devices regulate movement of the stopper by means of an electric motor and a system comprising a worm and a rack or, in some cases, by means of a rack and pinion system. The disadvantages of these devices are:

low response times; complexity of the parts; higher number of mechanical components that produce play, with consequent imprecise control of regulation and the need to perform maintenance on the system.

Given the presence of play, the position of the stopper-rod must also be measured by means of a linear transducer directly on the stopper arm, said sensor typically being delicate and subject to malfunctioning.

On the other hand, hydraulic or hydrodynamic devices allow better response compared to electromechanical devices; however, they require the presence of control units and valves which require a certain amount of space and imply a noteworthy increase in costs. Also in this case the presence of a high number of moving parts subject to wear between the lifting rod, which regulates upward or downward movement of the stopper, and the servomotor, and the presence of an oil filtering system, which must be kept constantly efficient, make frequent maintenance necessary.

An example of a hydraulic device to control the stopper is described in the document U.S. Pat. No. 5,421,559. In this device vertical movement to the lifting rod is transmitted by a rigid element integral therewith, connected at one end to a driving unit by means of the rod of a piston sliding inside a cylinder. Moreover, a costly system of valves is provided to control the flow of the hydraulic fluid to, from and between the opposite sides of the piston.

Therefore, there is the need for an innovative control device of the stopper-rod that allows the aforesaid drawbacks to be overcome.

SUMMARY OF THE INVENTION

A primary object of the present invention is to produce a control device of a stopper-rod, or simply stopper, which allows high operating speed of the stopper, with reduced overall dimensions.

Another object is to eliminate the play of all components involved in movement of the stopper, thus allowing greater precision and more precise regulation of the flow of steel. The absence of play also allows the position of the stopper-rod to be regulated using an angular sensor positioned on the motor means, advantageously a resolver. This sensor, integrated into the motor means, is notoriously much less delicate than a linear transducer and therefore less subject to malfunctioning.

A further object is to produce a device which does not require maintenance. Therefore, to attain the objects set forth above, the present invention provides a control device for a stopper according to the characteristics claimed in claim 1. Advantageously, the presence of a minimum number of moving parts between the lifting rod and the motor and the absence of play between said parts allow low response times and precise control of movement.

The device of the invention also has a high level of rigidity which allows precise movement transmission.

The dependent claims describe preferred embodiments of the invention.

BRIEF DESCRIPTION OF THE FIGURES

Further characteristics and advantages of the invention shall be more apparent in the light of the detailed description of a preferred, although non-exclusive, embodiment of a control device of a stopper-rod or stopper illustrated, by way of a non-limiting example, with the aid of the accompanying drawings, wherein.

DETAILED DESCRIPTION OF A PREFERRED EMBODIMENT OF THE INVENTION

Figure 1:
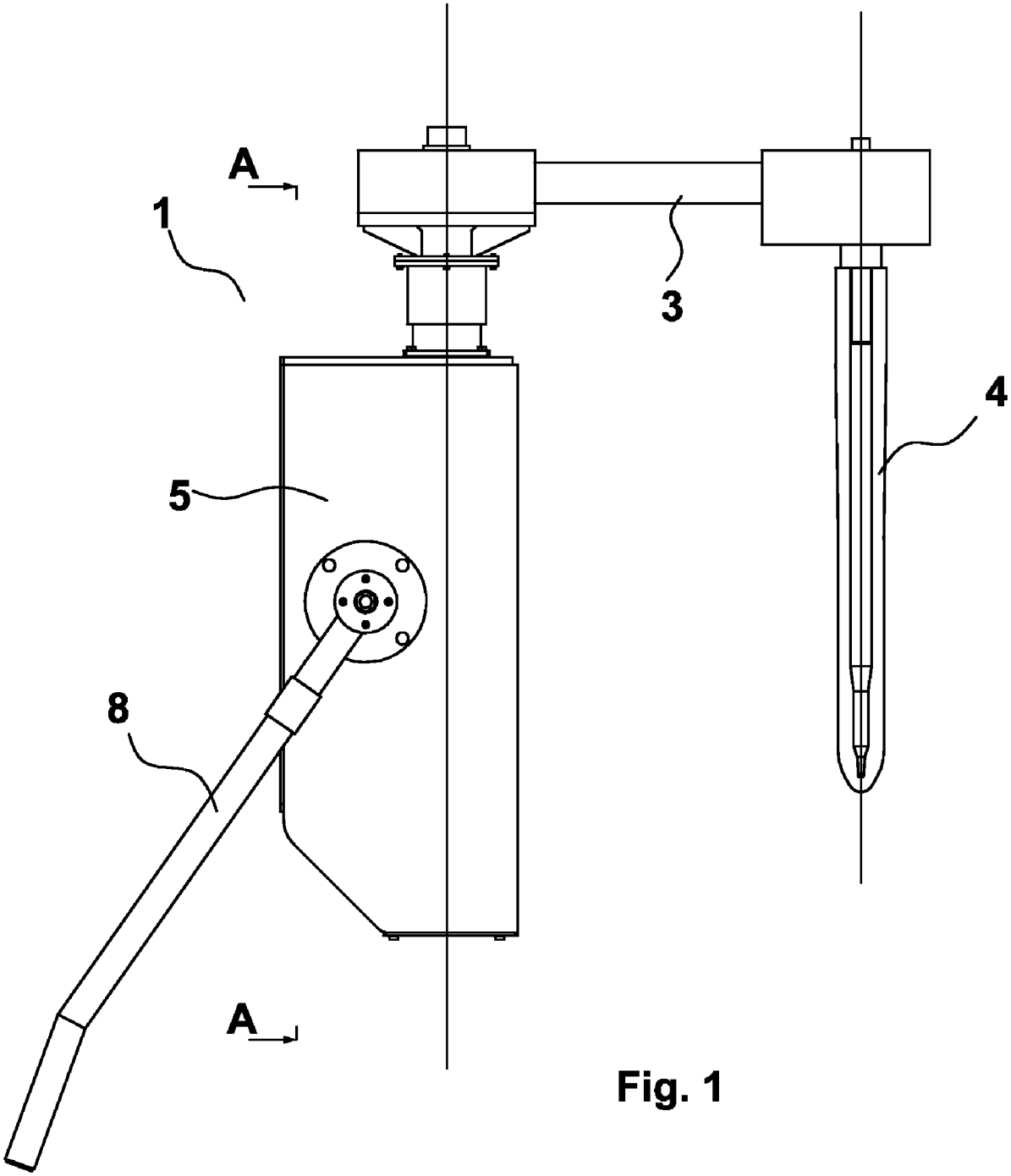
FIG. 1 represents a side view of the control device according to the invention.
Figure 2:
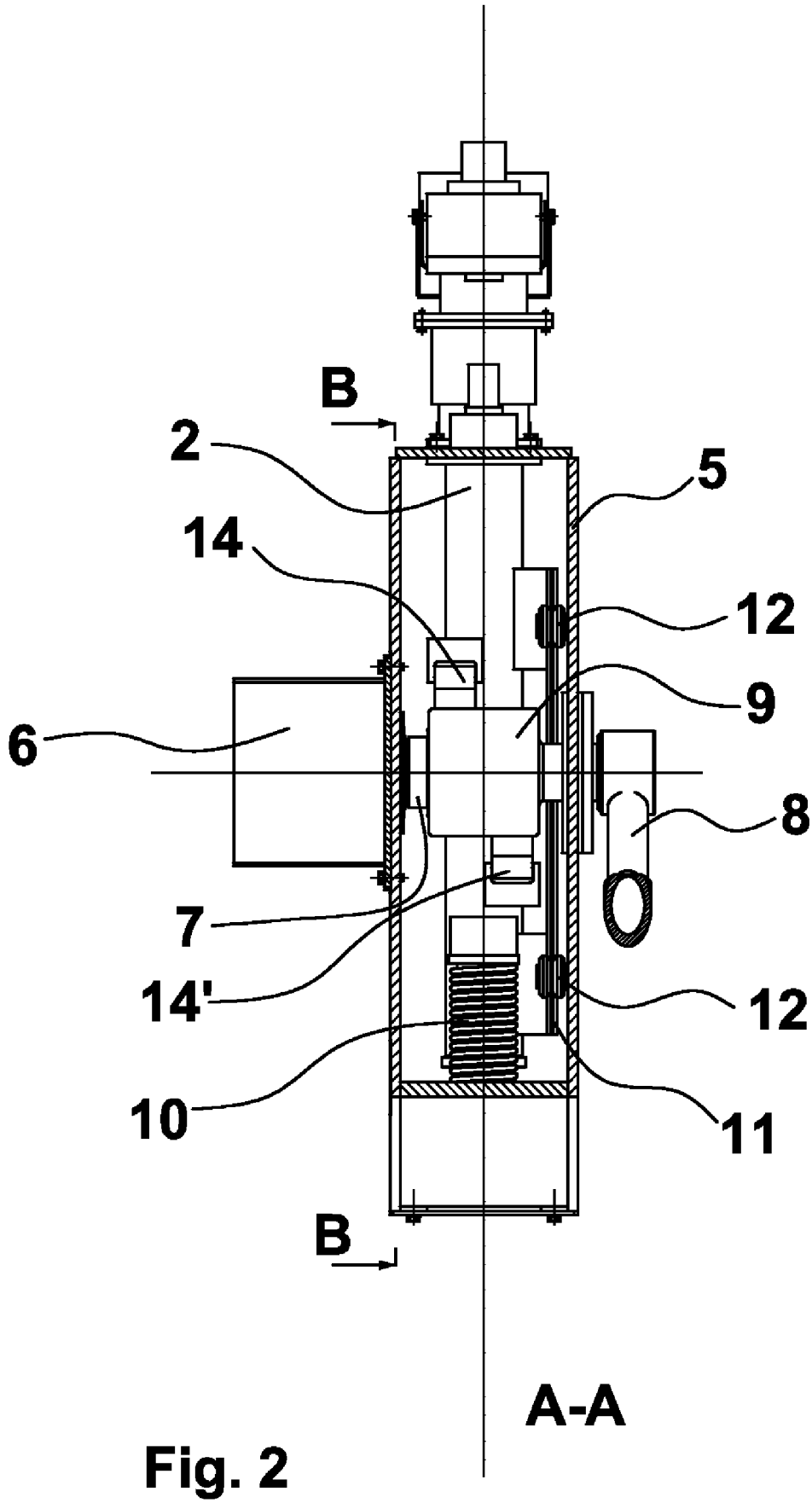
FIG. 2 represents a section according to the plane A-A of the device in FIG. 1.
Figure 3:
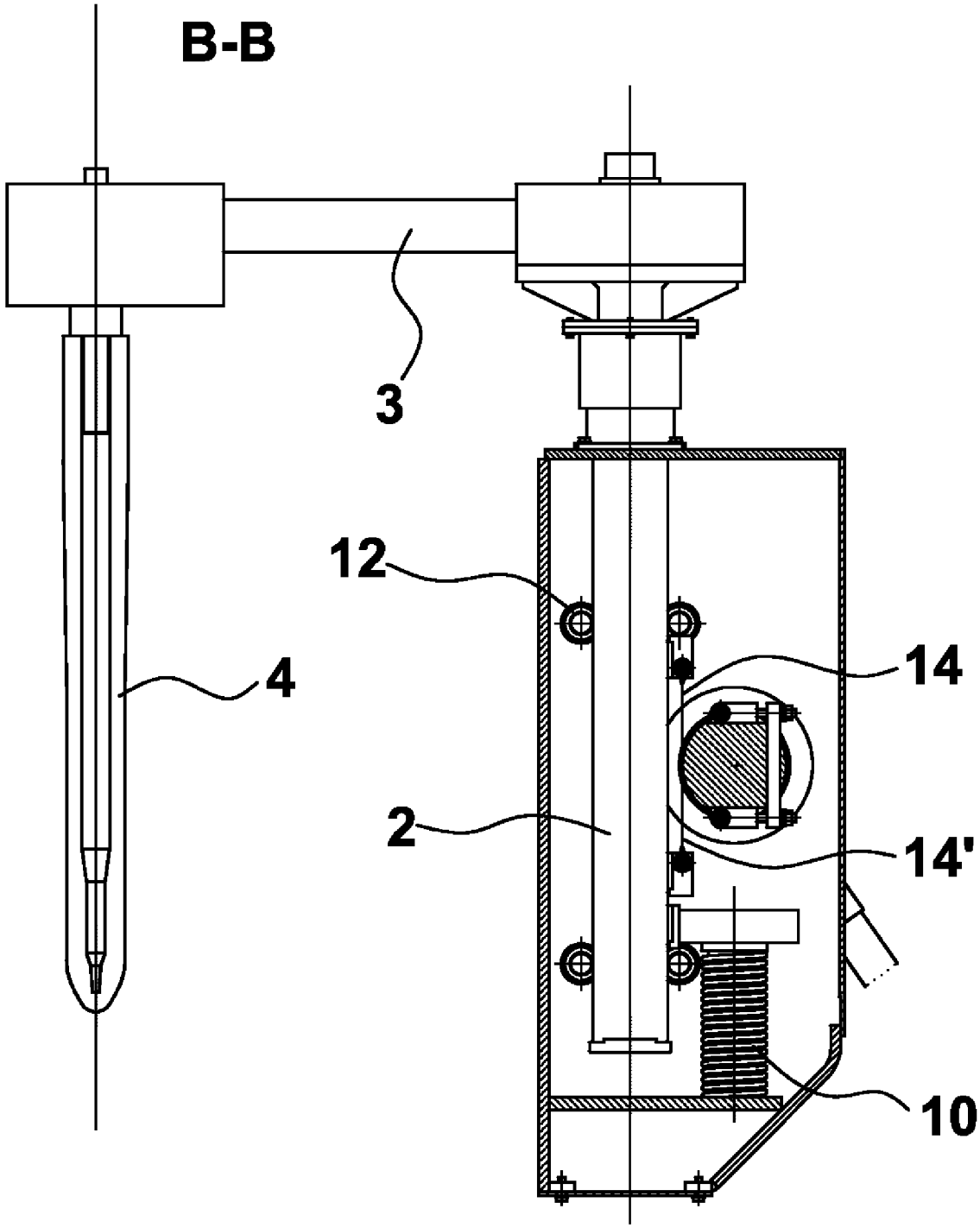
FIG. 3 represents a section according to the plane B-B of the device of the invention.

With reference to the figures, a control device for a stopper, indicated as a whole with the reference numeral 1, is represented. This device comprises:

motor means 6, a drive shaft 7, motion conversion means 14, 14';

a lifting and lowering rod or stem 2;

a connection element or arm 3.

The motor means, for example a planetary gearmotor 6, impart motion to the lifting and lowering rod or stem 2, housed in a retaining frame 5. Said gearmotor 6, or motor, has reduced dimensions, especially the axial dimensions; it has low inertia; reduced play; high rigidity and high power.

The direct drive gearmotor 6 is keyed onto one end of the drive shaft 7, essentially horizontal and passing through the retaining frame 5, while at the other end thereof an extractable lever 8 is fitted for manual control of the rod 2. Both the motor and the lever for manual control are outside the retaining frame.

Advantageously, the suspension bearing of the shaft does not require maintenance as it is lubricated for life and, being preloaded, is devoid of play.

The control device comprises two opposed belts 14, 14', or ropes or chains or other similar flexible elements, preferably made of spring steel, each of which is fixed, at one end, to the rod 2 and, at the other end, to a anchor plate 9 integral with the drive shaft 7. Belts or ropes or chains can also be non-metallic.

The function of the belts 14, 14', is to transform the rotating motion of the drive shaft 7 into the translational motion of the lifting and lowering rod or stem 2. One belt lifts the rod, while the other lowers it: in this way said belts are always and only subject to tensile stresses.

The use of belts principally allows two important advantages to be obtained:

avoidance of play, which is present in conventional worm and rack or rack and pinion systems.

and avoidance of maintenance, as belts are members not subject to wear.

Advantageously, provided inside the device of the invention is a drawn longitudinal guide 11 produced on a protrusion of the rod 2 and, in the example in the figures, facing the manual operating side. Said guide 11 slides inside four rolling elements 12, for example rollers, fixed to the retaining frame 5. Two of the rollers 12 are eccentric so that play between the longitudinal guide 11 and said rollers can be taken up and eliminated. This linear guide system allows precise and rapid movement of the rod 2 and does not require maintenance as the rolling elements are lubricated for life; moreover, the longitudinal guide 11 is resistant to high working loads and to wear, thanks to hardening of the surfaces thereof by means of special heat treatment. After motion has been transmitted to the rod 2, said rod allows the refractory stopper 4 to move upwards or downwards by means of an essentially horizontal connection element or arm 3.

Advantageously, in the event of a sudden power failure or in any other emergency situation, the refractory stopper 4 can descend by gravity to interrupt the flow of steel through the discharge hole of the ladle: descent of the stopper 2 by gravity is made possible by the gear motor 6 which, as mentioned above, is of the type with low inertia and is also reversible. Therefore, conventional electrical capacitors are no longer required in the device of the invention to guarantee an emergency closing movement.

With regard to manual regulation, the control lever 8 can be connected rapidly by means of a specific coupling. To block the rod 2 vertically in any position a braking hand-wheel is used. The manual control lever of the stopper can also be extracted rapidly.

Advantageously, a contrast spring 10 is provided, on which the rod 2 rests, either by means of a cantilevered support or directly. The function of the spring 10 is to compensate the masses in play of the system and to reduce the operating force required by the operator during the manual regulation phases by means of the specific lever 8.

The planetary gearmotor 6, used in the device of the invention, is composed of an alternating current brushless motor and a two-stage planetary reduction unit, with the first stage integrated into the second, and a reduction unit input pinion keyed directly onto the driving shaft. Advantageously, in this way the axial dimension is reduced by over 50%. Moreover, high values of torsional rigidity, decreased angular play, with a maximum value of 1 arcmin, and high precision and reliability are also obtained In the example of the device of the invention indicated in the figures, the total travel of the rod 2, and consequently the maximum movement of the stopper 4, is equal to 100 mm.

With the control device according to the present invention it is possible to obtain a response time to the step, and consequently a performance, equal to that of the hydrodynamic device, that is, about 50 milliseconds, while at the same time eliminating all the drawbacks of prior art control devices.

Finally, the present invention can also be applied to other known closing elements, other than the stopper or stopper-rod 2.

The particular embodiments described herein do not limit the content of this application, which covers all the variants of the invention defined by the claims.

The invention claimed is:

1. Control device for a stopper-rod to regulate the outflow of liquid metal through a calibrated hole of a pouring receptacle comprising motor means, suitable to operate lifting and lowering means of the stopper by means of first driving means and second driving means, the latter being suitable to convert a rotating motion into a translational motion, characterized in that said second driving means are flexible longitudinal elements and are fixed at a first end thereof to lifting and lowering means and at a second end thereof to an anchor element, integral with said first driving means.

2. Control device as claimed in claim 1, wherein said second driving means are belts.

3. Control device as claimed in claim 1, wherein said second driving means are ropes.

4. Control device as claimed in claim 1, wherein said second driving means are chains.

5. Control device as claimed in claim 1, wherein a guide element, integral with the lifting and lowering means, is provided, suitable to slide inside rolling elements fixed to a frame of the device.

6. Control device as claimed in claim 5, wherein said rolling elements are rollers.

7. Control device as claimed in claim 6, wherein some of said rollers are eccentric.

8. Control device as claimed in claim 1, wherein there are provided elastic means on which the lifting and lowering means rest.

9. Control device as claimed in claim 1, wherein the motor means comprise of a planetary reduction unit.

10. Control device as claimed in claim 8, wherein a guide element, integral with the lifting and lowering means, is provided, suitable to slide inside rolling elements fixed to a frame of the device.

11. Control device as claimed in claim 10, wherein said rolling elements are rollers.

12. Control device as claimed in claim 11, wherein some of said rollers are eccentric.

* * * * *